US010662693B2

(12) United States Patent
Kawase et al.

(10) Patent No.: US 10,662,693 B2
(45) Date of Patent: May 26, 2020

(54) PINCH DETECTION SWITCH

(71) Applicant: Hitachi Metals, Ltd., Tokyo (JP)

(72) Inventors: Kenji Kawase, Tokyo (JP); Shuichi Suzuki, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/385,797

(22) Filed: Apr. 16, 2019

(65) Prior Publication Data

US 2019/0338577 A1 Nov. 7, 2019

(30) Foreign Application Priority Data

May 2, 2018 (JP) ..... 2018-088826

(51) Int. Cl.
*H01H 3/14* (2006.01)
*H01H 3/16* (2006.01)
*E05F 15/44* (2015.01)

(52) U.S. Cl.
CPC ..... *E05F 15/44* (2015.01); *H01H 3/142* (2013.01); *H01H 3/161* (2013.01);
(Continued)

(58) Field of Classification Search
CPC . E05F 15/40; E05F 15/42; E05F 15/44; E05F 15/443; E05F 15/46;
(Continued)

(56) References Cited

U.S. PATENT DOCUMENTS 4,742,196 A * 5/1988 Kelly ..... H01B 7/10 200/85 R
7,055,885 B2 6/2006 Ishihara et al.
(Continued)

FOREIGN PATENT DOCUMENTS

EP 1526241 A1 4/2005
GB 2195207 A 3/1998
(Continued)

OTHER PUBLICATIONS

A Office Action issued in corresponding Japanese Application No. 2018-088826 dated Aug. 21, 2018.
(Continued)

*Primary Examiner* — Vanesssa Girardi
(74) *Attorney, Agent, or Firm* — Roberts Calderon Safran & Cole, P.C.

(57) ABSTRACT

A pinch detection switch includes a pressure sensing structure including at least one linear pressure sensing member with multiple conductor wires spaced apart from each other in an inner side of a tubular elastic body, and a tubular cover member to be attached to an end on a forward side in a moving direction of a movable body, and which is formed with a hollow portion which receives the pressure sensing structure. The pressure sensing structure includes a coating member which covers the at least one linear pressure sensing member, and which faces an inner surface of the hollow portion at both its ends in a width direction orthogonal to the moving direction of the movable body and an extending direction of the cover member. A position in the width direction of the at least one linear pressure sensing member in the hollow portion is defined by the coating member.

7 Claims, 6 Drawing Sheets

(52) U.S. Cl.
CPC ..... *E05Y 2400/552* (2013.01); *E05Y 2400/86* (2013.01); *E05Y 2900/531* (2013.01); *H01H 2003/165* (2013.01)

(58) Field of Classification Search
CPC .. E05F 2015/447; B60J 10/273; B60J 5/0495; H01H 3/142; H01H 3/161; H01H 13/183; H01H 2003/165
See application file for complete search history.

(56) References Cited

U.S. PATENT DOCUMENTS

| | | | | |
|---|---|---|---|---|
| 9,202,644 | B2 | 12/2015 | Aoyama et al. | |
| 9,417,099 | B2 * | 8/2016 | Bolbocianu | G01V 3/02 |
| 2004/0107640 | A1 | 6/2004 | Ishihara et al. | |
| 2005/0117270 | A1 | 6/2005 | Scherraus | |
| 2014/0318934 | A1 | 10/2014 | Aoyama et al. | |
| 2019/0390501 | A1 * | 12/2019 | Kawase | H01H 3/161 |

FOREIGN PATENT DOCUMENTS

| | | | |
|---|---|---|---|
| JP | 10-199363 | A | 7/1998 |
| JP | 2000-231853 | A | 8/2000 |
| JP | 2002-075117 | A | 3/2002 |
| JP | 2004-124465 | A | 4/2004 |
| JP | 2014-216300 | A | 11/2014 |

OTHER PUBLICATIONS

Extended European Search Report issued in the corresponding EP Application No. 19169937.0 dated Sep. 4, 2019.
Office Action issued in the corresponding JP Application No. 2018-203368 dated Jan. 9, 2020.

* cited by examiner

PINCH DETECTION SWITCH

CROSS-REFERENCE TO RELATED APPLICATIONS

The present application is based on Japanese patent application No. 2018-088826 filed on May 2, 2018, the entire contents of which are incorporated herein by reference.

BACKGROUND OF THE INVENTION

1. Field of the Invention

The present invention relates to a pinch detection switch for detecting pinching in a movable body such as a door closing and open portion in a vehicle such as an automobile.

2. Description of the Related Art

Conventionally, a pinch detection switch for detecting pinching is disposed in an end portion on a forward side in a moving direction of a movable body such as a slidable door of an automobile which can pinch a human body or baggage thereof (see e.g. JP-A-2014-216300).

A pinch detection switch (so-called "cord switch") described in JP-A-2014-216300 includes a cord switch main body, and a member to be attached, which functions as a bracket for fixing the cord switch main body to the slidable door. The cord switch body comprises a hollow tubular member having elasticity and insulation properties, a plurality of conductor wires spaced apart from each other and opposed to an inner surface of the tubular member, and a cord cover, which covers the tubular member.

The cord cover has a tubular shape in which a hollow portion which receives the tubular member is formed in a center portion, and a tubular member holding a conductor wire is inserted in that hollow portion. When the cord cover collides with a pinched object (for example, a human body) to be detected during forward movement in the moving direction (closing direction) of the slide door, the conductor wires held by the tubular member come into contact with each other due to the pressure caused by the collision, so the electric resistance between the conductor wires varies. The occurrence of pinching can then be detected by this change in electrical resistance.

SUMMARY OF THE INVENTION

In the pinch detection switch described in JP-A-2014-216300, at the time of assembly, it is necessary to insert the tubular member into a hollow portion of the cord cover over substantially the entire length of the cord cover. This work is difficult. Further, when the cord cover is sufficiently large as compared with the tubular member and no large frictional force is caused between the inner surface of the hollow portion and the outer circumferential surface of the tubular member, it is possible to easily insert the tubular member into the hollow portion, but, in this case, the position of the tubular member within the hollow portion becomes unstable, and it may be impossible to detect an appropriate pinching.

It is therefore an object of the present invention to provide a pinch detection switch, which is easy to assemble, and capable of properly performing pinch detection.

In order to solve the above-described problems, the present invention provides a pinch detection switch, comprising:

a pressure sensing structure including at least one linear pressure sensing member with a plurality of conductor wires spaced apart from each other in an inner side of a tubular elastic body; and a tubular cover member to be attached to an end portion on a forward side in a moving direction of a movable body, the tubular cover member being formed with a hollow portion which receives the pressure sensing structure, wherein the pressure sensing structure includes a coating member which covers the at least one linear pressure sensing member, and which is opposed to an inner surface of the hollow portion at both its end portions in a width direction at right angles to the moving direction of the movable body and an extending direction of the cover member, wherein a position in the width direction of the at least one linear pressure sensing member in the hollow portion is defined by the coating member.

Points of the Invention

The pinch detection switch according to the present invention is easy to assemble, and makes it possible to properly perform pinch detection.

DETAILED DESCRIPTION OF THE PREFERRED EMBODIMENTS

Embodiment

Figure 1:
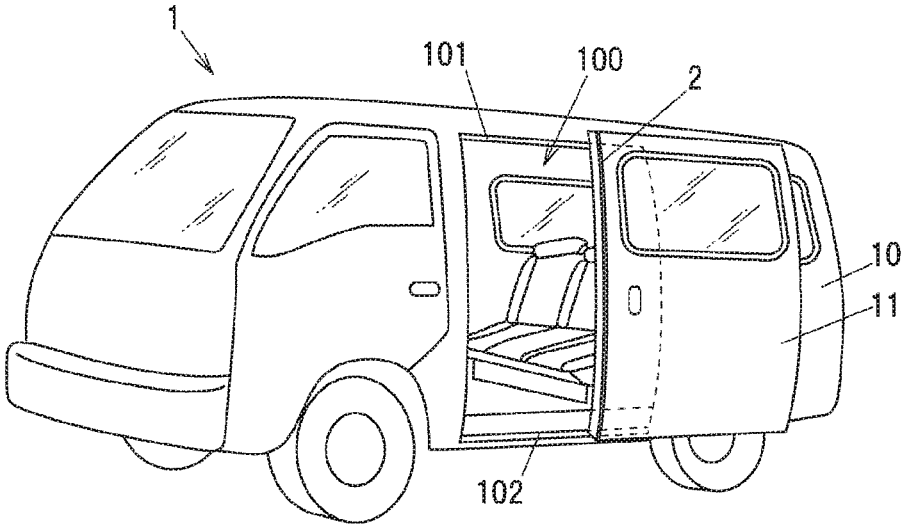
FIG. 1 is a configuration diagram showing a vehicle that is one example to which a pinch detection switch according to an embodiment of the present invention is applied.

FIG. 1 is a schematic diagram showing a vehicle as one example to which a pinch detection switch (also referred to as a pinch detection sensor, a door sensor, a door switch) according to an embodiment of the present invention is applied.

This vehicle 1 has a vehicle body 10 and a slidable door 11 that can open and close a door open portion 100 formed in the vehicle body 10. The slidable door 11 is guided to an upper guide rail 101 and a lower guide rail 102 and is moved in the front and rear directions of the vehicle 1 by the driving force of an electric motor. When the slidable door 11 is moved to the front of the vehicle 1, the door open portion 100 is closed. The slidable door 11 is an embodiment of a movable body of the present invention. Further, in the following description, the front direction of the vehicle, which is the closing direction, will be described as the forward direction of the moving directions.

In the end portion on the forward side in the moving direction of the slide door 11, a pinching detection switch 2 is extended and disposed along a vehicle vertical direction. When the pinch detection switch 2 comes in contact with a human body or baggage pinched to be detected when the slidable door 11 is closed, that contact is detected by a control device, and the control device stops or reverses the electric motor. This makes it possible to prevent the object to be detected from being strongly pinched between the slidable door 11 and the vehicle body 10.

Figure 2A:
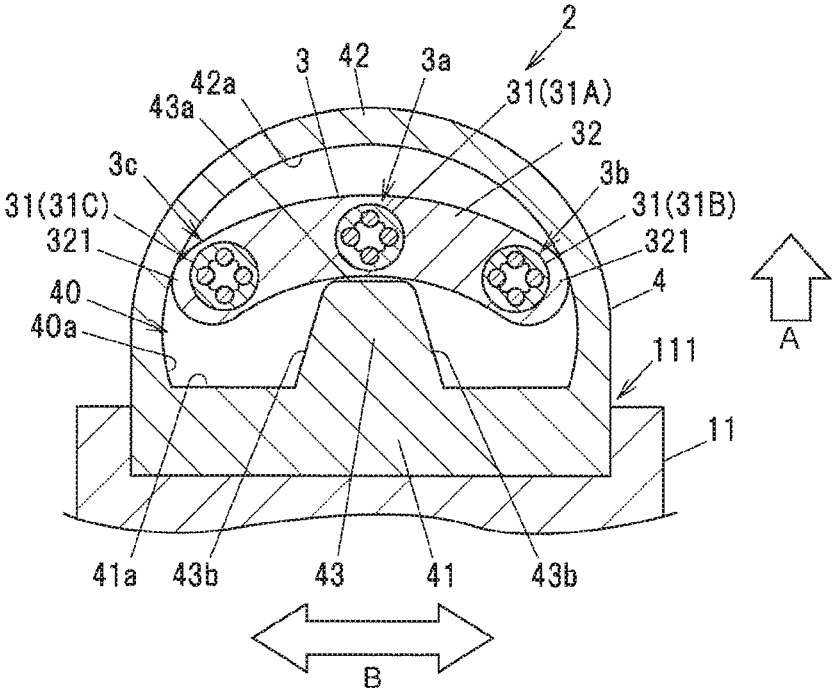
FIG. 2A is a cross sectional view showing the pinch detection switch at a cross section at right angles to a longitudinal direction.
Figure 2B:
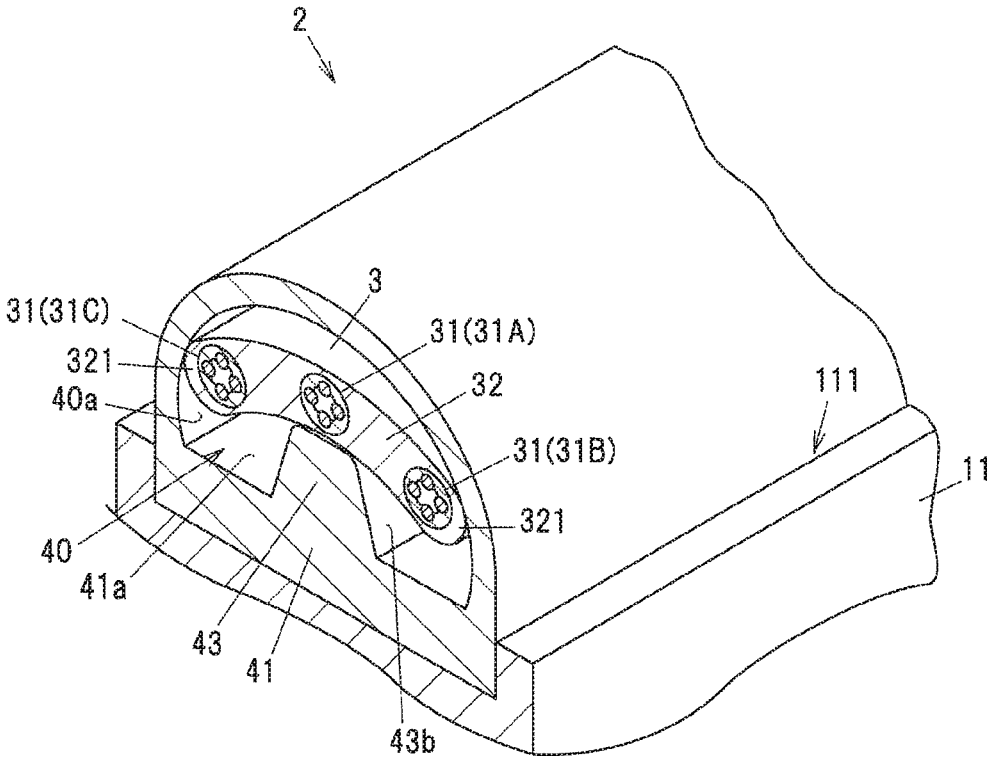
FIG. 2B is a perspective view showing the pinch detection switch.

FIG. 2A is a cross-sectional view showing the pinch detection switch 2 in a cross section at right angles to the longitudinal direction, FIG. 2B is a perspective view showing the pinch detection switch 2. In FIG. 2A, the vertical direction in the figure corresponds to the moving direction of the slidable door 11, and the forward direction in the moving direction of the slidable door 11 is indicated by an arrow A. Hereinafter, the forward direction in the moving direction of the slidable door 11 is simply referred to as the moving forward direction.

The pinch detection switch 2 includes a pressure sensing structure 3 having a linear pressure sensing member 31, a coating member 32 covering the linear pressure sensing member 31 and a tubular cover member 4 having a hollow portion 40 for receiving the pressure sensitive structure 3. In the present embodiment, the pressure sensing structure 3 is in the shape of a belt (a circular arc in FIG. 2A), and is disposed substantially over the entire end portion on the forward side in the moving direction of the slidable door 11. Further, in the present embodiment, the pressure sensing structure 3 has three of the linear pressure sensing members 31, and these three linear pressure sensing members 31 are arranged parallel to each other in the longitudinal direction of the pinch detection switch 2 (in the extending direction of the cover member 4). It should be noted, however, that the number of the linear pressure sensing members 31 in the pressure sensing structure 3 is not limited to three, but may be one, two, or four or more. That is, the pressure sensing structure 3 may have at least one linear pressure sensing member 31.

Figure 3:
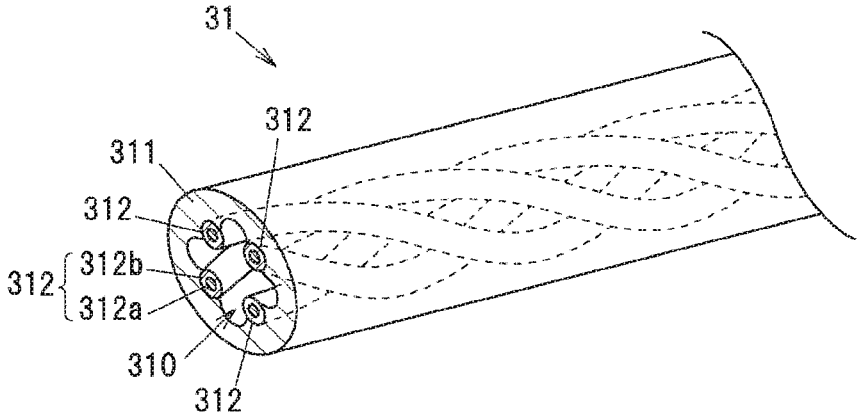
FIG. 3 is a perspective view showing one linear pressure sensing member 31.

FIG. 3 is a perspective view showing one linear pressure sensing member 31. The linear pressure sensing member 31 has a tube 311 which is a tubular elastic body, and a plurality of conductor wires 312 which are arranged to be separated from each other in an inner side of the tube 311. More specifically, four conductor wires 312 are helically held on the inner surface of the tube 311 while being partially exposed therefrom, and a space 310 having a cross-shaped cross section is formed in a center portion of the tube 311. Each conductor wire 312 is formed by covering a metal stranded wire 312*a* produced by stranding a plurality of metal wires together, with a conductive coating 312*b*, for example. The tube 311 is made of a rubber material such as silicone rubber or ethylene propylene rubber, and has an elasticity to be deformed by the exertion of an external force, and restored immediately no external force is exerted. In a natural state in which no external force is exerted to the tube 311, the plurality of conductor wires 312 are held in such a manner to be non-contact with each other.

In the present embodiment, the coating member 32 covers the three linear pressure sensing members 31 together. When the direction at right angles to the extending direction of the cover member 4 and the moving direction of the slidable door 11 is taken as the width direction of the coating member 32, the three linear pressure sensing members 31 are equally spaced apart in that width direction. In FIG. 2A, this width direction is indicated by an arrow B. The coating member 32 is formed by molding, and is received in the hollow portion 40 of the cover member 4 while being curved in such an arcuate shape that its middle portion in the width direction is protruded forward in the moving direction. That is, the pressure sensing structure 3 is a molded body in which the linear pressure sensing member 31 is molded with the coating member 32, and in the present embodiment, the three linear pressure sensing members 31 are held together to the coating member 32.

In the following description, when it is necessary to distinguish each of the three linear pressure sensing members 31 of the pressure sensing structure 3, the pressure sensing member 31 disposed in a middle portion 3*a* in the width direction of the pressure sensitive structure 3 will be described as the a first linear pressure sensing member 31A, and the other two linear pressure sensing members 31 will be described as a second linear pressure sensing member 31B and a third linear pressure sensing member 31C. The second and third linear pressure sensing members 31B and 31C are arranged in both width direction end portions 3*b* and 3*c* in both width direction sides, respectively, of the middle portion 3*a* in the width direction of the pressure sensing structure 3.

The cover member 4 integrally includes a base portion 41 fixed to an attachment portion 111 provided in an end portion on the forward side in the moving direction of the slide door 11, a cover portion 42 provided on the forward side in the moving direction relative to the base portion 41, to form the hollow portion 40 between it and the base portion 41, and a protruding portion 43 provided to be protruded from the base portion 41 toward the cover portion 42. The cover member 4 and the coating member 32 are made of, for example, urethane rubber, EP rubber, silicone rubber, styrene butadiene rubber, chloroprene rubber, olefin based or styrene based thermoplastic elastomer, urethane resin or the like, and they have elasticity to be deformed by pressing force caused by contact with the object to be detected.

The protruding portion 43 faces the middle portion 3*a* in the width direction of the pressure sensing structure 3 in the moving direction of the slidable door 11. In other words, the middle portion 3*a* in the width direction of the pressure sensing structure 3 and the protruding portion 43 are aligned in the moving direction of the slidable door 11. Also, the protruding portion 43 is protruded from the end face 41*a* on the forward side in the moving direction of the base portion 41 toward the cover portion 42, and the cross section shown in FIG. 2A (the cross section at right angles to the moving direction of the slidable door 11 and the extending direction of the cover member 4) is trapezoidal in shape.

Hereinafter, the tip surface in the protruding direction of the protruding portion 43 will be referred to as the top surface 43*a*, and the surfaces on both sides thereof will be described as the side surfaces 43*b*. The top surface 43*a* corresponds to a trapezoidal upper base, and both the side surfaces 43*b* correspond to trapezoidal legs. The top surface 43*a* and the side surfaces 43*b* form an obtuse angle in the cross section shown in FIG. 2A. In the present embodiment, the pressure sensing structure 3 is curved within the hollow portion 40 so as to cover the top surface 43*a* of the protruding portion 43 and at least a part of each of the both side surfaces 43*b*.

The coating member 32 is not fixed to the cover member 4, and the movement of the coating member 32 in the hollow portion 40 is regulated by the end portion 321 in the width direction of the coating member 32 being opposed to the inner surface 40*a* of the hollow portion 40. The positions of the first to third linear pressure sensing members 31A to 31C in the direction of the arrow B (the width direction of the coating member 32) within the hollow portion 40 are defined by the coating member 32. Of the first to third linear pressure sensing members 31A to 31C, the first linear pressure sensing member 31A is positioned at a position corresponding to the front in the moving direction of the top surface 43*a* of the protruding portion 43.

That is, for example, even when the pressure sensing structure 3 is acted on by a force in the moving direction in the width direction of the coating member 32 due to contact with the detection target of the pinching detection switch 2, the amount of movement of the pressure sensing structure 3 is restricted by the contact between the end portion 321 in the moving direction in the coating member 32 and the inner surface 40*a* of the hollow portion 40. In the present embodiment, the width direction dimension of the coating member 32 is configured so that both the end portions 321 and 321 in the width direction of the coating member 32 abut on the inner surface 40*a* of the hollow portion 40. However, the width direction dimension of the coating member 32 is not limited to this, but may be configured so that when the pressure sensing structure 3 is moved to one side in the width direction of the coating member 32, the end portion 321 in one side in the width direction of the coating member 32 abuts on the inner surface 40*a* of the hollow portion 40, and when the pressure sensing structure 3 is moved to the other side in the width direction of the coating member 32, the end portion 321 in the other side in the width direction of the coating member 32 abuts on the inner surface 40*a* of the hollow portion 40.

It should be noted, however, that, as in the present embodiment, when in a normal state where no pinching occurs, both the end portions 321 and 321 in the width direction of the coating member 32 are configured to abut on the inner surface 40*a* of the hollow portion 40, it is possible to more accurately position the first linear pressure sensing member 31A at a position corresponding to the front in the moving direction of the top surface 43*a* of the protruding portion 43, to thereby be able to improve the detection accuracy of the pinching. Note that the inner surface 40*a* of the hollow portion 40 includes the end face 41*a* on the forward side in the moving direction of the base portion 41 and the inner surface 42*a* of the cover portion 42.

Figure 4:
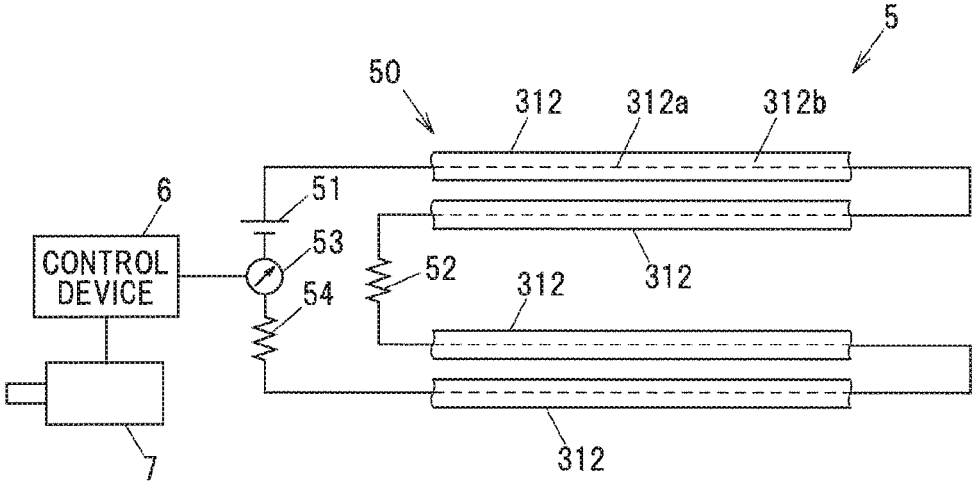
FIG. 4 is a circuit diagram showing one example of an electric circuit for detecting pinching in a slide door with the linear pressure sensing member together with a control device and an electric motor.

FIG. 4 is a circuit diagram showing one example of an electric circuit 5 for detecting the pinching in the slidable door 11 with the linear pressure sensing member 31 together with a control device 6 and an electric motor 7 for driving the slidable door 11. This electric circuit 5 is configured to include the four conductor wires 312 of the linear pressure sensing member 31, and has a power supply 51, a resistor 52 for contact detection, which connects together the end portions of two conductor wires 312 of the four conductor wires 312, an ammeter 53 and a resistor 54 for current limiting, which are connected in series with the power supply 51. The four conductor wires 312 are connected in series including the resistor 52. The ammeter 53 is configured to include a current sensor such as a Hall IC and the like and an amplifier, wherein a detection signal thereof is output to the control device 6.

In the electric circuit 5 configured as described above, when the linear pressure sensing member 31 is pressed to bring the conductor wires 312 into contact with each other, the electric resistance in the line 50 in which the four conductor wires 312 and the resistor 52 are connected in series varies. This change in electrical resistance is detected at the control device 6 as a change in current detected by the ammeter 53, where it is recognized that the linear pressure sensing member 31 has been pressed. When recognizing that the linear pressure sensing member 31 has been pressed during the closing operation of the slidable door 11, the control device 6 stops or reverses the electric motor 7.

Note that in FIG. 4, only the electric circuit 5 corresponding to one linear pressure sensing member 31 is shown, but in the present embodiment, since the pressure sensing structure 3 has the three linear pressure sensing members 31, the electric circuit 5 is provided to correspond to each of the linear pressure sensing members 31, and the detection signal of the ammeter 53 of each electric circuit 5 is outputted to the control device 6. The control device 6 stops or reverses the electric motor 7 when it recognizes that any of the linear pressure sensing members 31 has been pressed.

Figure 5:
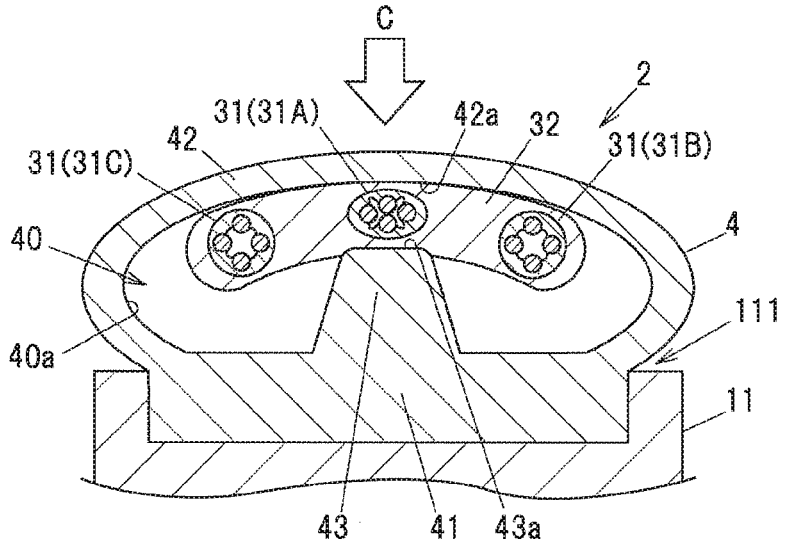
FIG. 5 is an explanatory view showing a state when an object to be detected comes into contact with a cover member of the pinch detection switch along a moving direction of the slidable door.

FIG. 5 is an explanatory view showing a state when the object to be detected comes into contact with the cover member 4 of the pinch detection switch 2 along the moving direction of the slidable door 11. In FIG. 5, the direction of the pressure acting on the pinch detection switch 2 is indicated by an arrow C. In this case, the first linear pressure sensing member 31A is sandwiched between the top surface 43*a* of the protruding portion 43 and the inner surface 42*a* of the cover portion 42 so that the conductor wires 312 of the first linear pressure sensing member 31A are brought into contact (short circuited) with each other. Then, the occurrence of pinching in the slidable door 11 is detected by the first linear pressure sensing member 31A.

Figure 6:
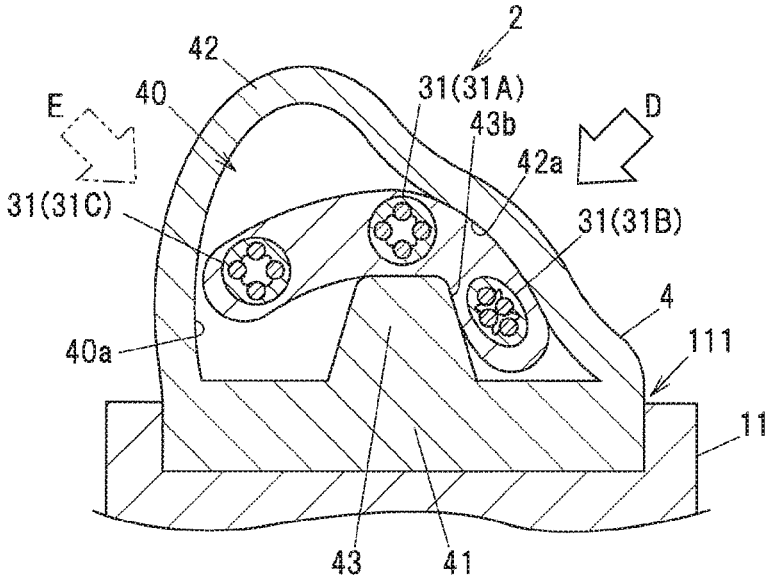
FIG. 6 is an explanatory view showing a state when the object to be detected comes into contact with the cover member along a direction tilted with respect to the moving direction of the slidable door.

FIG. 6 is an explanatory view showing a state when the object to be detected comes into contact with the cover member 4 along a direction tilted with respect to the moving direction of the slidable door 11. Such a contact state (a case where the detection as shown in FIG. 5 is impossible) can occur in a case where, for example, baggage (for example, a corded pass case) of a person outside the vehicle 1 is left behind in the inner side of the slidable door 11, and that person pulls his baggage from the exterior of the vehicle. In FIG. 6, the direction of pressure acting on the pinch detection switch 2 is indicated by an arrow D. In this illustrated example, the second linear pressure sensing member 31B is sandwiched between the side surface 43*b* of the protruding portion 43 and the inner surface 42*a* of the cover portion 42, and the conductor wires 312 are brought into contact (short circuited) with each other. Then, the pinching in the slidable door 11 is detected by the second linear pressure sensing member 31B.

Note that although not shown, when the object to be detected comes into contact with the cover member 4 along the direction tilted in the direction opposite to the moving direction of the slidable door 11 (the direction of the arrow E indicated by the two-dot chain line in FIG. 6), the conductor wires 312 of the third linear pressure sensing member 31C are brought into contact (short circuited) with each other.

Figure 7:
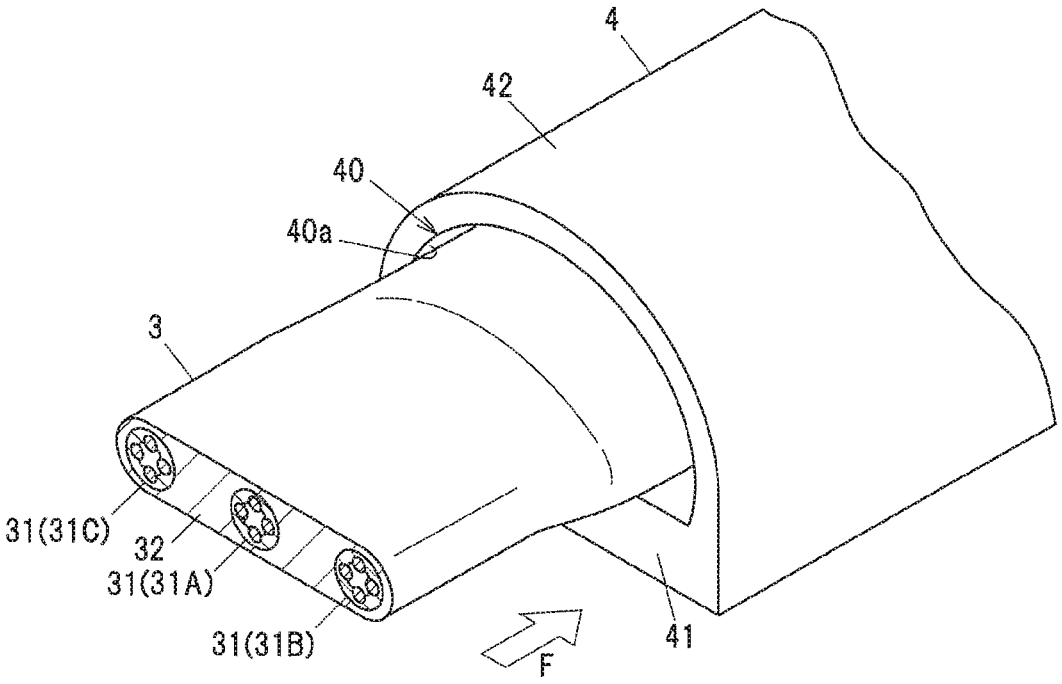
FIG. 7 is an explanatory view showing an assembling step of inserting a pressure sensing structure into a hollow portion of the cover member at the time of producing the pinch detection switch.

FIG. 7 is an explanatory view showing an assembling step of inserting the pressure sensing structure 3 into the hollow portion 40 of the cover member 4 at the time of producing the pinch detection switch 2. In FIG. 7, the insertion direction of the pressure sensing structure 3 is indicated by an arrow F.

In the pressure sensing structure 3, the coating member 32 has a flat plate shape in a natural state before being received in the hollow portion 40 of the cover member 4. Then, the pressure sensing structure 3 is inserted into the hollow portion 40 with the coating member 32 being elastically deformed to be curved in an arcuate shape. With both the end portions 321 and 321 in the width direction of the coating member 32 being abutted (elastically abutted) on the inner surface 40*a* of the hollow portion 40 by the restoring force thereof, and being slid on the inner surface 40*a*, the coating member 32 is inserted into the hollow portion 40. Note that, in order to suppress the sliding resistance in this case, a lubricant may be applied to the surface of the coating member 32 in sliding contact with the inner surface 40*a* of the hollow portion 40.

(Modifications)

Figure 8:
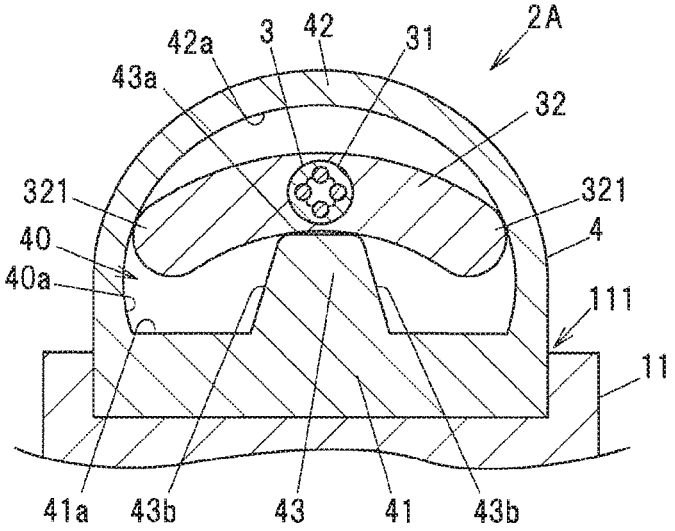
FIG. 8 is a cross-sectional view showing a pinch detection switch according to a first modified embodiment.
Figure 9:
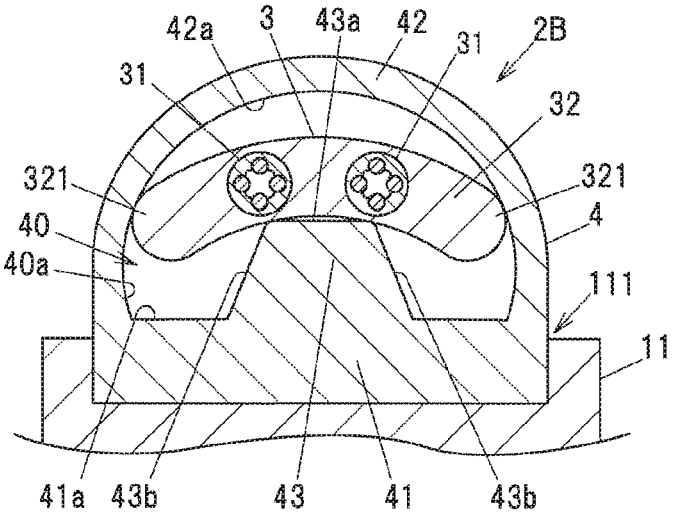
FIG. 9 is a cross-sectional view showing a pinch detection switch according to a second modified embodiment.
Figure 10:
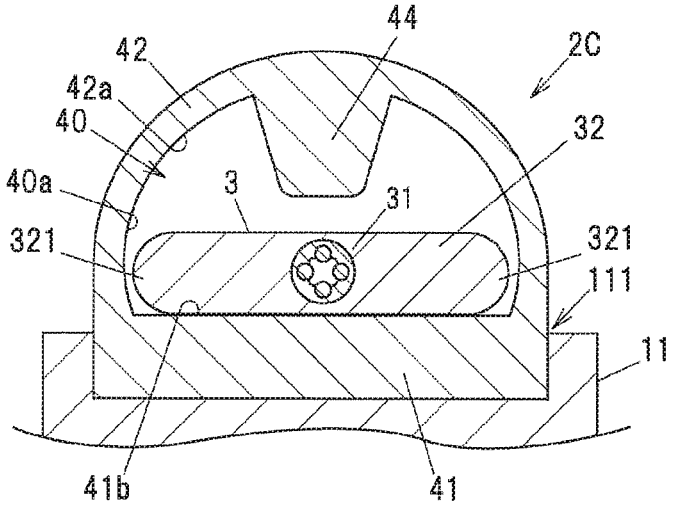
FIG. 10 is a cross-sectional view showing a pinch detection switch according to a third modification.

FIGS. 8 to 10 are cross-sectional views showing pinch detection switches 2A to 2C according to modifications to the embodiment. In FIGS. 8 to 10, constituent elements common to those described in the above embodiment are given the same reference numerals as those used in FIG. 2A and the like, and duplicated explanations thereof are omitted.

The first modification shown in FIG. 8 is a modification example when the pressure sensing structure 3 has only one linear pressure sensing member 31. In this case, the one linear pressure sensing member 31 is disposed on the forward side in the moving direction of the protruding portion 43 of the cover member 4. In this configuration, as compared with the above embodiment, when the object to be detected comes into contact with the cover member 4 along a direction tilted with respect to the moving direction of the slidable door 11, the detection precision of the pinching lowers, but the occurrence of pinching in the direction along the moving direction of the slide door 11 which occurs at a highest occurrence frequency can securely be detected.

The second modification shown in FIG. 9 is a modification example when the pressure sensing structure 3 has two linear pressure sensing members 31. In this case, the two linear pressure sensing members 31 are arranged on the forward side in the moving direction of a corner between the top face 43*a* and both the side faces 43*b* of the protruding portion 43 of the cover member 4. In comparison with the above-described embodiment, this configuration can reduce the number of linear pressure sensing members 31 to reduce the cost, and makes it possible to detect pinching in the direction along the moving direction of the slidable door 11, and pinching in a direction tilted with respect to the direction of movement of the slidable door 11.

In the third modified embodiment shown in FIG. 10, the pressure sensing structure 3 has only one linear pressure sensing member 31, and a protruding portion 44 which is protruded toward that one linear pressure sensing member 31 is provided to be protruded rearward in the moving direction of the slidable door 11 from the cover portion 42 of the cover member 4. The coating member 32 faces the end face 41*a* on the forward side in the moving direction of the base portion 41 while maintaining its flat plate shape, with slight gaps being formed between both the end portions 321 and 321 respectively in the width direction and the inner surface 42*a* of the cover portion 42. The movement of the coating member 32 in the width direction is restricted by these gaps being closed so that either end portion 321 of both the end portions 321 and 321 of the coating member 32 abuts on the inner surface 42*a* of the cover portion 42, which is a part of the inner surface 40*a* of the hollow portion 40. This allows the position of the linear pressure sensing member 31 to be defined to the rear side in the moving direction of the protruding portion 44.

Operation and Advantageous Effects of the Embodiment

According to the embodiment and its modifications described above, the coating member 32 is interposed between the linear pressure sensing member 31 and the inner surface 40*a* of the hollow portion 40 in the cover member 4, so that the position of the linear pressure sensing member 31 is defined by the coating member 32. Further, when the pressure sensing structure 3 is inserted into the hollow portion 40 of the cover member 4 during producing of the pinch detection switch 2, the rigidity of the pressure sensing structure 3 in this insertion direction is ensured by the coating member 32, and the ratio of the contact area of the outer surface of the coating member 32 in contact with the inner surface 40*a* of the hollow portion 40 is limited. Therefore, this work can easily be performed. This makes it easy to assemble, and makes it possible to properly perform pinch detection.

SUMMARY OF THE EMBODIMENT

Next, the technical ideas grasped from the above-described embodiments will be described with the aid of reference numerals and the like in the embodiments. It should be noted, however, that each of the reference numerals and the like in the following description does not limit the constituent elements in the claims to the members and the like specifically shown in the embodiments.

[1] A pinch detection switch (2), comprising:

a pressure sensing structure (3) including at least one linear pressure sensing member (31) with a plurality of conductor wires (312) spaced apart from each other in an inner side of a tubular elastic body; and a tubular cover member (4) to be attached to an end portion on a forward side in a moving direction of a moveable body (slidable door 11), the tubular cover member (4) being formed with a hollow portion (40) which receives the pressure sensing structure (3), wherein the pressure sensing structure (3) includes a coating member (32) which covers the at least one linear pressure sensing member (31), and which is opposed to an inner surface (40*a*) of the hollow portion (40) at both its end portions (321, 321) in a width direction at right angles to the moving direction of the movable body (11) and an extending direction of the cover member (4), wherein a position in the width direction of the at least one linear pressure sensing member (31) in the hollow portion (40) is defined by the coating member (32).

[2] The pinch detection switch (2) according to [1] above, wherein the at least one linear pressure sensing member (31) is disposed in a middle portion (3*a*) in the width direction of the pressure sensing structure (3), wherein the cover member (4) includes a protruding portion (43/44) which faces the middle portion (3*a*) of the pressure sensing structure (3) in the moving direction of the movable body (11).

[3] The pinch detection switch (2) according to [2] above, wherein the pressure sensing structure (3) includes three of the linear pressure sensing members (31), and one (31A) of the three linear pressure sensing members (31) is disposed in the middle portion (3*a*) and other two (31B, 31C) of the three linear pressure sensing an embers (31) are disposed in both sides, respectively, in the width direction of the middle portion (3*a*).

[4] The pinch detection switch (2) according to [3] above, wherein the cover member (4) includes a base portion (41) to be fixed to the movable body (11), and a cover portion (42) to be provided on the forward side in the moving direction of the movable body (11) relative to the base portion (41), to form the hollow portion (40) between it and the base portion (41), wherein the protruding portion (43) is provided to protrude from the base portion (41) toward the cover portion (42), wherein when a pinched object to be detected comes in contact with the cover member (4) along the moving direction of the movable body (11), the linear pressure sensing member (31A) disposed in the middle portion (3*a*) is sandwiched between a top surface (43*a*) of the protruding portion (43) and an inner surface (42*a*) of the cover portion (42), wherein when the pinched object to be detected comes into contact with the cover member (4) along a direction tilted with respect to the moving direction of the movable body (11), either one (31B, 31C) of the two linear pressure sensing members (31B, 31C) disposed in both the sides in the width direction of the middle portion (3*a*) the linear pressure sensing members (31) is sandwiched between a side surface (43*a*) of the protruding portion (43) and the inner surface (42*a*) of the cover portion (42).

[5] The pinch detection switch (2) according to [4] above, wherein the pressure sensing structure (3) is curved so as to at least partially cover the top surface (43*a*) and the side surface (43*b*) of the protruding portion (43) within the hollow portion (40).

[6] The pinch detection switch (2) according to any one of [1] to [5] above, wherein both the end portions (321, 321) of the coating member (32) of the pressure sensing structure (3) abut on the inner surface (40*a*) of the hollow portion (40) in a normal state in which no pinching occurs.

[7] The pinch detection switch (2) according to any one of [1] to [6] above, wherein the pressure sensing structure (3) is a molded body in which the at least one linear pressure sensing member (31) is molded with the coating member (32).

Although the embodiment of the present invention has been described above, the embodiment described above does not limit the invention according to the claims. It should also be noted that not all combinations of the features described in the embodiments are indispensable to the means for solving the problem of the invention.

Further, the present invention can appropriately be modified and carried out within the scope not deviating from the spirit thereof. For example, although in the above-described embodiment, there has been described the case in which the coating member 32 is in a flat plate shape in the natural state before being received in the hollow portion 40 of the cover member 4, the coating member 32 may be molded into a curved shape. Further, the shape of the coating member 32 in the natural state is not limited to a flat plate shape, but maybe, for example, a U shape or a V shape which is protruded toward the forward side in the moving direction or the rear side in the moving direction.

Also, with respect to the pressure sensing structure (3), one or more linear pressure sensing members (31) may be structured to be arranged side by side on the adhesive surface side of a wide tape and then sandwiched between that tape and another wide tape. That is, it is a pressure sensing structure with a single or a plurality of linear pressure sensing members (31) arranged between two tapes. In this case, the outer surface shape of the pressure sensing structure is not an elliptical shape in a cross section view as shown in FIG. 7, but only a portion of the linear pressure sensing member (31) is in a protruding shape, and when a plurality of the linear pressure sensing members (31) are arranged, a pressure sensing structure having a wavy outer surface shape is produced.

With this structure, as the pressure sensing structure, in a cross section view, a thick portion in which the linear pressure sensing member is disposed and a non-thick portion in which no linear pressure sensing member is disposed are formed, but this non-thick portion, in other words, the portion where the thickness of the pressure sensing structure is thin is a portion which is easily deformed. That is, this ease of deformation contributes to ease of producing the pinch detection switch.

Further, with respect to the pressure sensing structure (3) having a plurality of the linear pressure sensing members (31), the coating member (32) between the linear pressure sensing members may be provided with a cut (a groove) along the linear pressure sensing members. With this configuration, as the pressure sensing structure, in a cross-sectional view, thick portions where the linear pressure sensing members are disposed and non-thick portions between the linear pressure sensing members are formed, but this non-thick portion, in other words, the portion where the thickness of the pressure sensing structure is thin is a portion which is easily deformed. That is, this ease of deformation contributes to ease of producing the pinch detection switch.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A pinch detection switch, comprising:

a pressure sensing structure including at least one linear pressure sensing member with a plurality of conductor wires spaced apart from each other in an inner side of a tubular elastic body; and a tubular cover member to be attached to an end portion on a forward side in a moving direction of a movable body, the tubular cover member being formed with a hollow portion which receives the pressure sensing structure, wherein the pressure sensing structure includes a coating member which covers the at least one linear pressure sensing member, and which is opposed to an inner surface of the hollow portion at both its end portions in a width direction at right angles to the moving direction of the movable body and an extending direction of the cover member, wherein a position in the width direction of the at least one linear pressure sensing member in the hollow portion is defined by the coating member.

2. The pinch detection switch according to claim 1, wherein both the end portions of the coating member of the pressure sensing structure abut on the inner surface of the hollow portion in a normal state in which no pinching occurs.

3. The pinch detection switch according to claim 1, wherein the pressure sensing structure is a molded body in which the at least one linear pressure sensing member is molded with the coating member.

4. The pinch detection switch according to claim 1, wherein the at least one linear pressure sensing member is disposed in a middle portion in the width direction of the pressure sensing structure, wherein the cover member includes a protruding portion which faces the middle portion of the pressure sensing structure in the moving direction of the movable body.

5. The pinch detection switch according to claim 4, wherein the pressure sensing structure includes three of the linear pressure sensing members, and one of the three linear pressure sensing members is disposed in the middle portion and other two of the three linear pressure sensing members are disposed in both sides, respectively, in the width direction of the middle portion.

6. The pinch detection switch according to claim 5, wherein the cover member includes a base portion to be fixed to the movable body, and a cover portion to be provided on the forward side in the moving direction of the movable body relative to the base portion, to form the hollow portion between it and the base portion, wherein the protruding portion is provided to protrude from the base portion toward the cover portion, wherein when a pinched object to be detected comes in contact with the cover member along the moving direction of the movable body, the linear pressure sensing member disposed in the middle portion is sandwiched between a top surface of the protruding portion and an inner surface of the cover portion, wherein when the pinched object to be detected comes into contact with the cover member along a direction tilted with respect to the moving direction of the movable body, either one of the two linear pressure sensing members disposed in both the sides in the width direction of the middle portion the linear pressure sensing members is sandwiched between a side surface of the protruding portion and the inner surface of the cover portion.

7. The pinch detection switch according to claim 6, wherein the pressure sensing structure is curved so as to at least partially cover the top surface and the side surface of the protruding portion within the hollow portion.

* * * * *